United States Patent [19]

Huang et al.

[11] Patent Number: 4,735,696

[45] Date of Patent: Apr. 5, 1988

[54] METHOD OF ELECTROLYTICALLY GRAINING ALUMINUM METAL SHEETS SUITABLE FOR LITHOGRAPHIC PLATE SUPPORTS

[75] Inventors: Jen-Chi Huang, Mount Kisco, N.Y.; Donald Riley, Tenafly, N.J.

[73] Assignee: Polychrome Corporation, Yonkers, N.Y.

[21] Appl. No.: 43,566

[22] Filed: Apr. 27, 1987

[51] Int. Cl.[4] ..... C25F 3/04

[52] U.S. Cl. ..... 204/129.43; 204/129.75

[58] Field of Search ..... 204/129.4, 129.43, 129.75, 204/129.9

[56] References Cited

U.S. PATENT DOCUMENTS

| | | | |
|---|---|---|---|
| 2,930,741 | 3/1960 | Burger | 204/129.4 |
| 3,249,523 | 5/1966 | Post | 204/129.43 |
| 4,477,317 | 10/1984 | Chu | 204/129.4 |

*Primary Examiner*—T. M. Tufariello

[57] ABSTRACT

A method for producing aluminum sheets for lithographic plates by electrolytically etching the surface in an aqueous mineral acid electrolyte solution utilizing direct current with superimposed alternating current. The surface of aluminum plate sheets may be mechanically grained prior to the step of electrolytic etching.

8 Claims, No Drawings

METHOD OF ELECTROLYTICALLY GRAINING ALUMINUM METAL SHEETS SUITABLE FOR LITHOGRAPHIC PLATE SUPPORTS

FIELD OF THE INVENTION

The present invention relates to a method for preparing a support for a lithographic printing plate which comprises electrolytically graining the surface of an aluminum metal sheet in an aqueous acidic solution with direct current superimposed with alternating current.

BACKGROUND OF THE INVENTION

As set forth in U.S. Pat. No. 4,477,317, many methods have been proposed in the treatment of aluminum surfaces to render them suitable for use in the preparation of lithographic printing plates. A commercially utilized method involves subjecting aluminum metal plates or sheets to electrolytic graining or etching in an aqueous acidic electrolyte. U.S. Pat. Nos. 3,072,546 and 3,073,765 disclose the treatment of aluminum surfaces in a hydrochloric acid electrolyte while applying an alternating current. Aluminum plates treated by the so-called alternating current acid electrolyte procedure renders the plates suitable for the production of lithographic printing plates. More specifically, this procedure results in an aluminum surface which is uniformly roughened, hydrophilic surfaces which are more receptive and adherent to light-sensitive coatings. The average roughness values of such treated surfaces are designated as Ra micrometers.

In recent years there has been a need to increase the production of lithographic printing plates in order to meet growing commercial demands. An attempt was made to speed up the line of aluminum sheet passing through the alternating current tank containing the aqueous acidic electrolyte and thereby produce additional substrate material for lithographic printing plates. It was found, however, that the increase in line speed has a serious disadvantage in that resulting aluminum surface does not have adequate average roughness values required to produce quality aluminum metal supports for lithographic printing plates. Upon investigation it was found that with conventional alternating current etching or graining it takes a relatively long etching time to achieve the desired metal surface roughness. More particularly, the alternating etching of an aluminum sheet in hydrochloric acid takes at least 30 seconds at 75 amps per square decimeter to reach an average roughness value of 0.7 micrometer starting from smooth aluminum. It follows that the replacement of present equipment, such etching tanks and electric power supplies, as well as increased amount of electrolyte solution that would be required to maintain product quality at higher aluminum sheet line speeds would be extremely costly.

As is also known, the use of direct current rather than alternating current results in aluminum sheet surfaces with a non-uniform roughened pattern characterized by undesirable deep pitting.

It would be advantageous therefore to have a method for increasing the line speed of aluminum sheet passing through an electrolyte solution in an etching or graining treatment without loss of the product quality required for suitable supports in lithographic printing plates.

SUMMARY OF THE INVENTION

In accordance with the present invention it has now been found that an effective method for electrolytically etching or graining the surface of aluminum sheet at higher line speeds without quality loss involves utilizing direct current superimposed with alternating current. The starting aluminum metal sheet may be mechanically grained prior to the electrolytic treatment.

DETAILED DESCRIPTION OF THE INVENTION

In general, the present invention pertains to a method for obtaining a desirable aluminum metal surface for use as a lithographic printing plate by electrolytically etching with direct current superimposed with an alternating current, the aluminum metal sheet being the anode of the direct current circuit. More particularly, the present invention relates to the use of a direct current (DC) with a superimposed alternating current (AC) in the electrolytic etching of aluminum metal sheet in an aqueous acidic electrolyte. By employing the method of this invention the surface topography of the aluminum metal sheet, i.e. the average surface roughness, is attained rapidly thereby permitting an increase in the aluminum metal sheet line speed without adversely affecting the product quality. In other words, the use of the special current allows for greater production while avoiding equipment and material modifications.

In U.S. Pat. No. 4,170,739 a number of methods are disclosed for providing direct current with a superimposed alternating current. Column 1, line 19 through Column 4, line 5, are incorporated herein by reference. Sinusoidal or non-sinusoidal alternating current can be employed, and this new power supply may be considered as a source of modulated voltage wherein the direct current voltage is a carrier and the sinusoidal or non-sinusoidal alternating current is a modulating current. Although the total current may be varied over a wide range, the DC portion may range from 2 to 40 amps per square decimeter with the AC portion ranging from 10 to 50 amps per square decimeter of aluminum surface being treated. Preferred ranges are 12 to 27 amps per square decimeter for the DC portion and 15 to 30 amps per square decimeter for the AC portion. The DC portion must be less than the AC peak current or voltage. Otherwise the result is the same as when using pulse DC alone.

In order to achieve the desired surface topography, i.e., an average roughness of at least 0.5 micrometer in 15 seconds, utilizing a pumice grained aluminum base having an original Ra of 0.32 micrometer, it is necessary to maintain a peak ratio of DC to AC of from about 0.65:1 to 0.9:1.0.

For some purposes, it is preferable to start with smooth aluminum metal sheet; however, the sheet may be mechanically grained by such procedures as wire brushing, sand blasting, dry brush graining, and wet mass graining prior to the step of electrolytic graining.

The starting aluminum sheet is preferably at least 99 percent pure. Aluminum alloys such as Nos. 1100, 3003, 1145 or 1050 alloys as well as others wherein the aluminum is combined with a small percentage of manganese and/or copper are also suitable.

The electrolytic baths suitable in the practice of this invention include aqueous solutions of mineral acids selected from the group consisting of hydrochloric acid, nitric acid, phosphoric acids and mixtures thereof.

The concentration of the mineral acid(s) in bath may vary from about 0.5 to 3.0% by weight, while the temperature of these baths may range from 20° C. to 50° C. It will be understood that neither the mineral acid concentration nor the temperature of the electrolytic bath are critical features of the present invention. What is important, however, is that the aluminum line or web speed can be substantially increased so that treatment time is decreased to below about 30 seconds, and preferably ranges from about 13 to 17 seconds. By utilizing the special current of the present invention, the average roughness of the electrolytically etched or grained surface will not be adversely affected and will be at least 0.5 Ra.

Subsequent to the electrolytic etching or graining of the aluminum metal surface in accordance with the present invention, the aluminum metal substrate may be further treated to produce finished lithographic printing plates. Thus, the electrolytically treated aluminum metal substrate may be coated with lithographically photosensitive compositions well known in this art. Alternatively the electrolytically treated aluminum may be anodized prior to applying the photosensitive composition.

The invention will be more fully understood by reference to the following illustrative embodiments.

EXAMPLE 1

Run A

Smooth AA 3003 aluminum metal sheeting (Ra equals 0.15 micrometer) was passed through a electrolyte bath, an aqueous solution containing 2.5% hydrochloric acid and 0.7% tartaric acid. The period of electrolytic treatment was 33 seconds utilizing a direct current superimposed with alternating current. The total current and the AC and DC portions are set forth in the following table along with the average roughness values expressed in micrometers (Ra).

| Amps Per Square Decimeters | | Ra |
|---|---|---|
| AC | DC | Micrometer |
| 16 | 9 | 0.32 |
| 31 | 12 | 0.60 |
| 39 | 17 | 0.81 |

Run B

Starting again with smooth aluminum metal sheeting (0.15 Ra micrometer) an electrolytic treatment was carried out in aqueous hydrochloric acid (1% by weight) with alternating current. It required 75 amps per square decimeter of aluminum metal and 30 seconds of electrolytic treatment to reach a value of 0.6 Ra micrometers.

EXAMPLE 2

Pumice grained AA 1050 aluminum metal sheeting (Ra=0.32 micrometer) was electrolytically etched in an aqueous 1% hydrochloric acid and 1% nitric acid bath for 15 seconds utilizing the currents set forth below.

| Amps Per Square Decimeter | | Average |
|---|---|---|
| AC | DC | Roughness (Ra) Micrometer |
| 33 | 5 | 0.42 |
| 31 | 10 | 0.46 |
| 26 | 20 | 0.52 |

The above data demonstrate that a suitable roughness can be achieved in shorter processing times using DC superimposed with AC in accordance with the present invention.

It will be further understood that various changes and modifications can be made in the method of the present invention without departing from the broader scope thereof. The various embodiments which have been disclosed herein are for the purpose of further illustrating the invention but not for limiting the invention.

What is claimed is:

1. A method for preparing a support for a lithographic printing plate comprising electrolytically etching an aluminum sheet, as an anode in an acidic electrolytic bath utilizing direct current superimposed with an alternating current and wherein the DC portion is less than the AC peak current or voltage.

2. The method of claim 1 wherein the aluminum sheet is mechanically grained prior to electrolytic graining.

3. The method of claim 1 wherein the acidic electrolytic bath comprises aqueous solution of a mineral acid selected from the group consisting of hydrochloric acid, nitric acid, phosphoric acid and mixtures thereof.

4. The method of claim 1 wherein the mineral acid is hydrochloric acid.

5. The method of claim 1 wherein said electrolytic etching is carried out for a sufficient time to obtain uniform roughness value of at least 0.5 Ra micrometer.

6. The method of claim 5 wherein said electrolytic etching is carried out for a time period ranging from about 5 to 20 seconds.

7. The method of claim 1 wherein alternating current superimposed on the direct current has a current density ranging from about 12 to 27 amps per square decimeter and the direct current ranges from about 15 to 30 amps per square decimeter.

8. The method of claim 7 wherein the direct current to alternating current ratio ranges from 0.65:1.0 to 0.9:1.0.

* * * * *